US012752992B2

(12) United States Patent
Scherer et al.

(10) Patent No.: US 12,752,992 B2
(45) Date of Patent: Oct. 6, 2026

(54) CONTAINERS HAVING ATTACHABLE DIVIDER HANDLES AND BLANKS THEREFOR

(71) Applicant: WestRock Shared Services, LLC, Atlanta, GA (US)

(72) Inventors: Alyssa J. Scherer, Duluth, GA (US); John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 641 days.

(21) Appl. No.: 18/021,107

(22) PCT Filed: Aug. 12, 2021

(86) PCT No.: PCT/US2021/045636

§ 371 (c)(1),
(2) Date: Feb. 13, 2023

(87) PCT Pub. No.: WO2022/036020

PCT Pub. Date: Feb. 17, 2022

(65) Prior Publication Data

US 2023/0312205 A1 Oct. 5, 2023

Related U.S. Application Data

(60) Provisional application No. 63/065,899, filed on Aug. 14, 2020.

(51) Int. Cl.
*B65D 71/58* (2006.01)

(52) U.S. Cl.
CPC ..... *B65D 71/0025* (2013.01); *B65D 2571/00141* (2013.01); *B65D 2571/0037* (2013.01);

(Continued)

(58) Field of Classification Search
CPC ..... B65D 71/0025; B65D 2571/00141; B65D 2571/0037; B65D 2571/00506;

(Continued)

(56) References Cited

U.S. PATENT DOCUMENTS 2,288,457 A 6/1942 Inman
2,529,675 A * 11/1950 Brulin ..... B65D 5/46184 229/117.14
2,609,137 A * 9/1952 Toensmeier ..... B65D 5/46072 229/117.22
2,712,882 A * 7/1955 Buttery ..... B65D 5/48008 206/172

(Continued)

FOREIGN PATENT DOCUMENTS

DE 20 2012 004386 U1 6/2012
EP 2017182 A2 1/2009

(Continued)

OTHER PUBLICATIONS

International Search Report issued in PCT/US2021/045636, dated Dec. 10, 2021.
European Office Action dtd Jun. 5, 2026, 5 pages.

*Primary Examiner* — Christopher R Demeree
(74) *Attorney, Agent, or Firm* — Brian J. Goldberg; Rohini K. Garg

(57) ABSTRACT

A container (100, 300) configured to carry a plurality of articles includes a body (101, 301) configured to form an interior space (105, 305). The body (101, 301) includes at least a side wall (107, 307) and a bottom (109, 309). The container (101, 301) includes a divider handle (111, 311) that can be configured to attach to the body (101, 301). The divider handle (111, 311) forms a handle and at least one divider configured to divide the interior space (105, 305) into at least two compartments.

19 Claims, 10 Drawing Sheets

(52) U.S. Cl.
CPC ..... *B65D 2571/00506* (2013.01); *B65D 2571/00666* (2013.01)

(58) Field of Classification Search
CPC ..... B65D 2571/00666; B65D 2571/00512; B65D 2571/0066; B65D 2571/00728; B65D 5/46064; B65D 71/0022; B65D 2571/00487; B65D 5/46184; B65D 2571/00388; B65D 2571/00382; B65D 2571/00413; B65D 2501/24216; B65D 85/34
USPC ..... 229/120.18, 117.14, 117.22, 117.23, 229/120.12, 120.25, 120.26, 120.29, 229/125.01, 164, 912; 206/200, 166, 180, 206/193, 167, 169, 170, 143, 163, 172, 206/176, 198
See application file for complete search history.

(56) References Cited

U.S. PATENT DOCUMENTS

| | | | | | |
|---|---|---|---|---|---|
| 2,746,638 | A | | 5/1956 | Champlin | |
| 3,198,379 | A | | 8/1965 | Creelman | |
| 3,402,849 | A | * | 9/1968 | Matthews | B65D 71/0077 206/176 |
| 4,264,031 | A | | 4/1981 | Goebel | |
| 4,318,470 | A | * | 3/1982 | Montealegre | B65D 5/48008 229/117.14 |
| 4,469,222 | A | * | 9/1984 | Graser | B65D 71/38 206/427 |

FOREIGN PATENT DOCUMENTS

| | | | | | |
|---|---|---|---|---|---|
| GB | 653992 | A | * | 5/1951 | B65D 5/3642 |
| KR | 2017 0129365 | A | | 11/2017 | |

* cited by examiner

Rule Legend

| | |
|---|---|
| ———————— | Cut |
| ..... | Crease |
| — — — — — | 1/4 x 1/4 Perf (gap) |
| ———————— | 1/2 x 1 cut & crease |
| ..... | Coating Free Area |
| ..... | Inside Bleed |
| ..... | Outside Bleed |

CONTAINERS HAVING ATTACHABLE DIVIDER HANDLES AND BLANKS THEREFOR

CROSS REFERENCE TO RELATED APPLICATIONS

This Application is a U.S. 371 National Phase Patent Application of International PCT Patent Application No. PCT/US2021/045636, filed Aug. 12, 2021, which claims priority to U.S. Provisional Patent Application No. 63/065,899, filed on Aug. 14, 2020. The entire contents of these applications are incorporated herein by reference.

FIELD

This disclosure relates to containers and blanks therefor.

BACKGROUND

Certain containers for carrying certain items can be difficult to form for an end user, and/or can be difficult to carry once formed. Additionally, if preformed, the certain containers can be voluminous and expensive to ship in a formed condition.

Such conventional methods and systems have generally been considered satisfactory for their intended purpose. However, there is still a need in the art for improved containers and blanks therefor. The present disclosure provides a solution for this need.

SUMMARY

In accordance with at least one aspect of this disclosure, a container configured to carry a plurality of articles can include a body configured to form an interior space. The body can include at least a side wall and a bottom, for example. The container can include a divider handle that can be configured to attach to the body. The divider handle can form a handle and at least one divider configured to divide the interior space into at least two compartments.

The divider handle can be configured to moveably attach to the body such that the handle is configured to move between a first position and a second position. The divider handle can be configured to be slidably retained by the body such that the divider handle can be configured to slide between the first position and the second position.

The body can define a plurality of slide apertures configured to receive a slide panel of the divider handle to allow the divider handle to slide between the first position and the second position. The side wall can be formed from a plurality of side panels. The container can include a plurality of slide aperture panels foldably connected to opposing side panels of the plurality of side panels. The slide aperture panels can fold over a respective side panel to a folded position to form the slide apertures.

The slide aperture panels can be configured to connect to the body to retain the slide aperture panels in the folded position. In certain embodiments, the first position can be a recessed position within the interior space, and the second position can be an extended position extending from the interior space and interacting with the body, e.g., such that the divider handle allows lifting of the body in at least the extended position.

In certain embodiments, the divider handle can be configured to be fixed relative to the body. The body can include a plurality of attachment apertures, and the divider handle can include a plurality of attachments configured to insert into the attachment apertures to fix the divider handle to the body and to allow the body to be lifted by the divider handle.

In certain embodiments, the divider handle can include a handle opening defined therein. In certain embodiments, the divider handle can include one or more moveable partition panels configured to move relative to a main handle portion of the divider handle to further divide the interior space. The moveable partition panels can include two movable partition panels, for example.

In certain embodiments, the moveable partition panels can be foldably connected to the main handle portion and configured to selectively divide the interior space. In certain embodiments, the moveable partition panels can be configured to connect to the body and can each include one of the plurality of attachments configured to insert into the attachment apertures. The divider handle can be configured to divide the interior space into two, three, or four compartments, for example. In certain embodiments, the moveable partition panels include a portion of the handle opening.

In certain embodiments, the bottom can be an autobottom configured to move between a flattened state and a formed state. In certain embodiments, the container can include one or more vent holes defined in the side wall and/or the bottom.

In accordance with at least one aspect of this disclosure, a plurality of blanks or a blank configured to be separated into the plurality of blanks can be configured to form a container as disclosed herein, e.g., as described above. For example, in accordance with at least one aspect of this disclosure, a plurality of blanks for forming a container can include a first blank configured to form a body as disclosed herein, e.g., as described above. The plurality of blanks can include a second blank configured to form a divider handle as disclosed herein, e.g., as described above.

In certain embodiments, the first blank can include a first, second, third, and fourth side panel foldably connected together. The first blank can include a first, second, third, and fourth bottom panel foldably connected to a respective side panel along a common fold line. The first blank can include a first and second slide aperture panel foldably connected to the second side panel opposite the second bottom panel. The first blank can include a third and fourth slide aperture panel foldably connected to the fourth side panel opposite the fourth bottom panel.

The first, second, third, and fourth slide aperture panels can include a tab extending therefrom. The second and fourth bottom panels can include a respective tab cut for each tab. Each tab can be configured to be inserted into each respective tab cut to retain each slide aperture panel in a folded over position where the aperture panels form a respective slide aperture.

In certain embodiments, the second blank can include a first and second main handle panel foldably connected together. Each handle panel can include a handle aperture defined therein. The second blank can include a first and second slide panel foldably connected to opposite sides of the first main handle panel, and dimensioned to fit within and slide within a respective slide aperture. The second blank can include a third and fourth slide panel foldably connected to opposite sides of the second main handle panel, and dimensioned to fit within and slide within a respective slide aperture.

The second blank can include a first moveable partition panel assembly foldably connected to the first main handle panel. The second blank can include a second moveable partition panel assembly foldably connected to the second main handle panel.

The first and second moveable partition panel assemblies can each include a connecting panel foldably connected to a respective main handle panel, a partition panel foldably connected to the connecting panel, and a slider panel foldably connected to the connecting panel and extending laterally beyond the respective main handle panel. The slider panel can be configured to fit within a slide aperture with a respective slide panel.

In certain embodiments, the first blank can include a first, second, third, fourth, fifth, and sixth side panel foldably connected together, a first, second, third, fourth, fifth, and sixth bottom panel foldably connected to a respective side panel along a common fold line, and a first, second, and third attachment aperture disposed in the side panels. The first attachment aperture can be defined in the first and second side panels. The second attachment aperture can be defined in the third and fourth side panels. The third attachment aperture can be defined in the fifth and sixth panels. The attachment apertures can each be disposed in a fold line between a respective panel pair.

The first blank can include a first, second, third, fourth, fifth, and sixth bottom panel foldably connected to a respective side panel at a common fold line and configured to form an autobottom. The third bottom panel and the fifth bottom panel can include a locking tab connected thereto and/or extending therefrom configured to lock together in a formed position.

The second blank can include a first and second main handle panel foldably connected to each other, and a first and second partition panel foldably connected to the first and second main handle panel, respectively. In certain embodiments, the first and second partition panel are not directly connected. The second blank can include a first handle aperture defined between the first main handle panel and the first partition panel, and a second handle aperture defined between the second main handle panel and the second partition panel.

In certain embodiments, the first and second partition panels can be shaped as a mirror image of each respective main handle panels. In certain embodiments, the first and second partition panels can include a first and second attachment tab extending therefrom, respectively. The first and second main handle panels can include a third and fourth attachment tab, respectively. The first attachment tab can be configured to insert into the first attachment aperture and the second attachment tab can be configured to insert into the second attachment aperture, for example. The third and fourth attachment tabs can be configured to insert together into the third attachment aperture.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
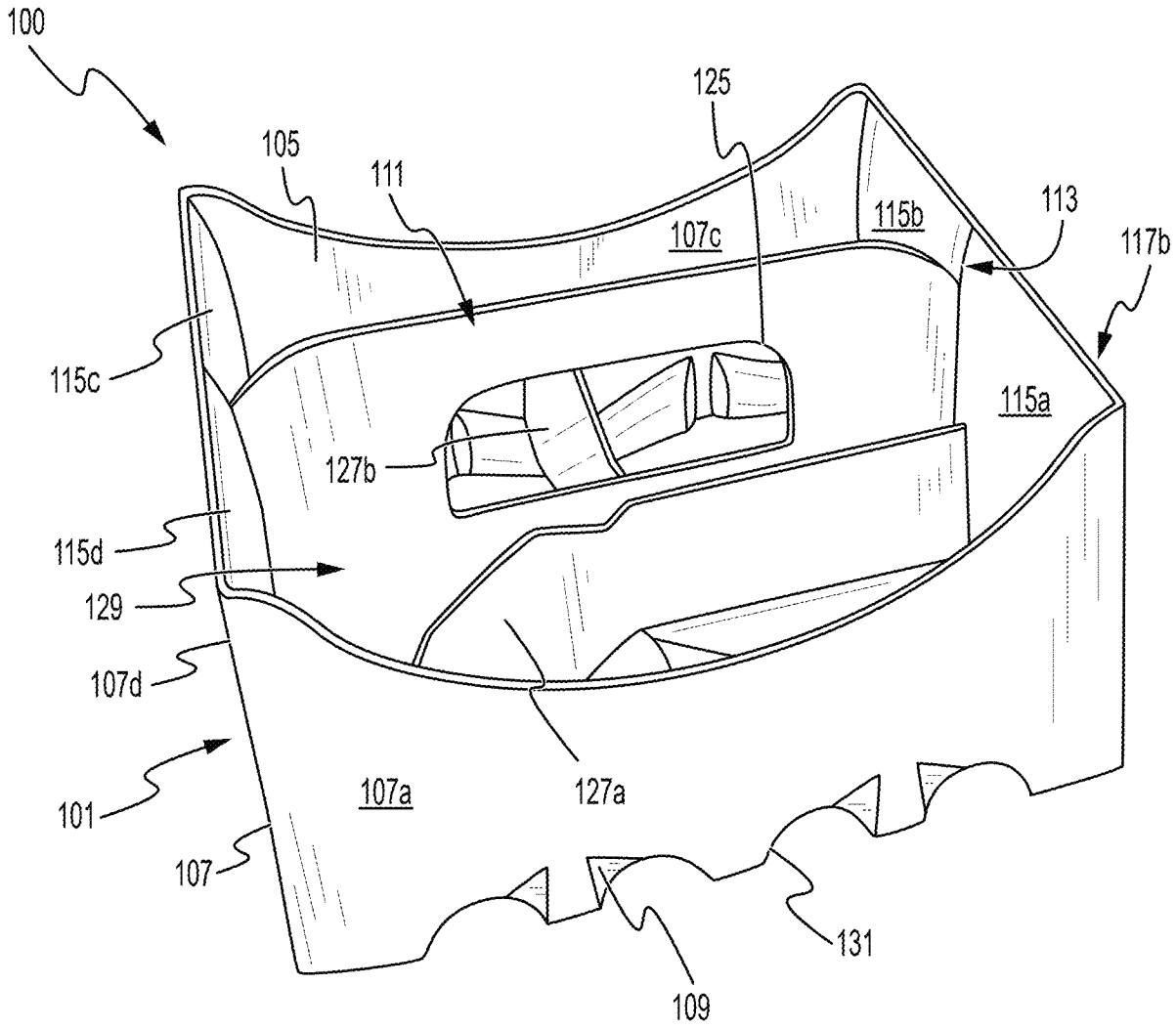
FIG. 1A is a perspective view of an embodiment of a container in accordance with this disclosure, shown in a formed position and having a divider handle thereof retained by a body thereof in a recessed position.

Reference will now be made to the drawings wherein like reference numerals identify similar structural features or aspects of the subject disclosure. For purposes of explanation and illustration, and not limitation, an illustrative view of an embodiment of a container in accordance with the disclosure is shown in FIGS. 1A and 1*s* designated generally by reference character 100. Other embodiments and/or aspects of this disclosure are shown in FIGS. 1B-4B. Certain embodiments described herein can be used to hold any suitable product, for example.

In accordance with at least one aspect of this disclosure, referring to FIGS. 1A-1C and 3A-3C, a container 100, 300 configured to carry a plurality of articles (e.g., produce or any other suitable goods) can include a body 101, 301 configured to form an interior space 105, 305. The body 101, 301 can include at least a side wall 107, 307 and a bottom 109, 309, for example. The container 100, 300 can include a divider handle 111, 311 that can be configured to attach to the body 101, 301. The divider handle 111, 311 can form a handle (e.g., as shown) and at least one divider (e.g., as shown) configured to divide the interior space 105, 305 into at least two compartments. Any suitable number of compartments is contemplated herein.

Figure 1B:
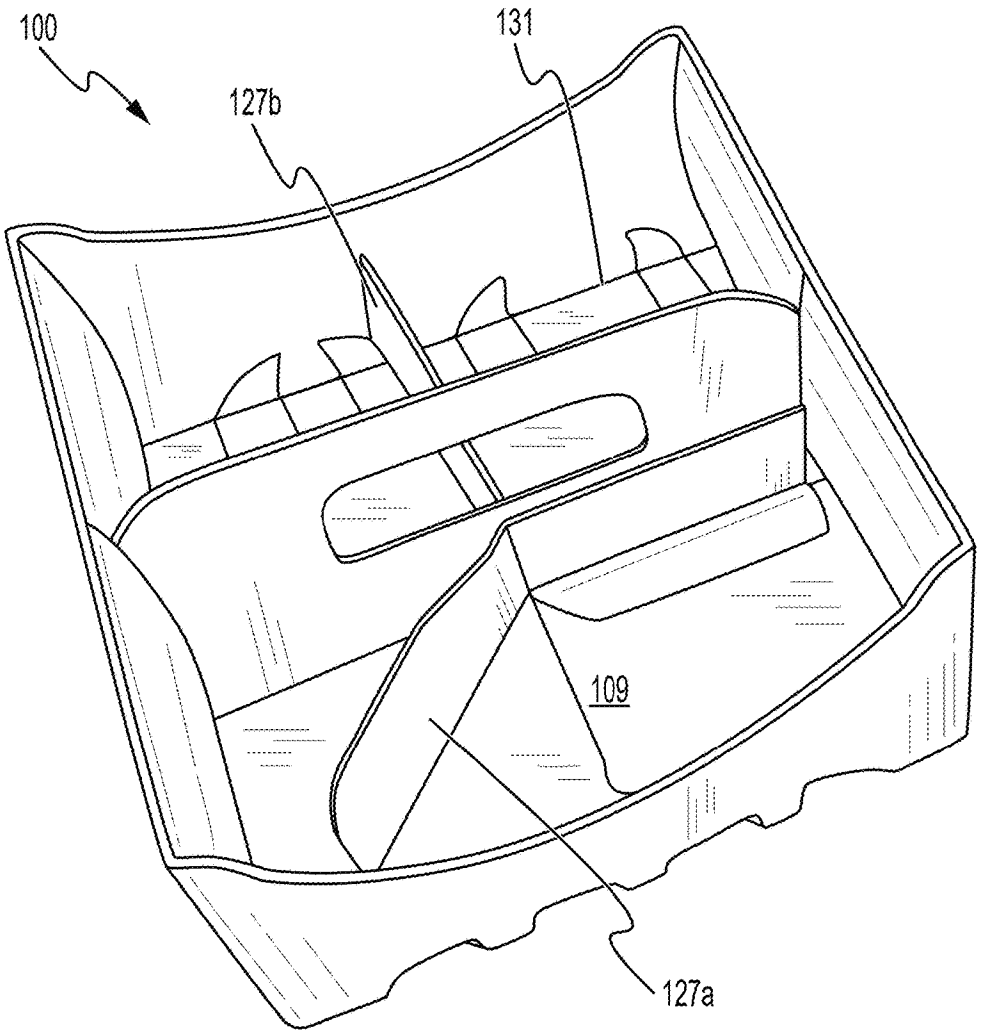
FIG. 1B is a perspective view of the embodiment of FIG. 1A.
Figure 1C:
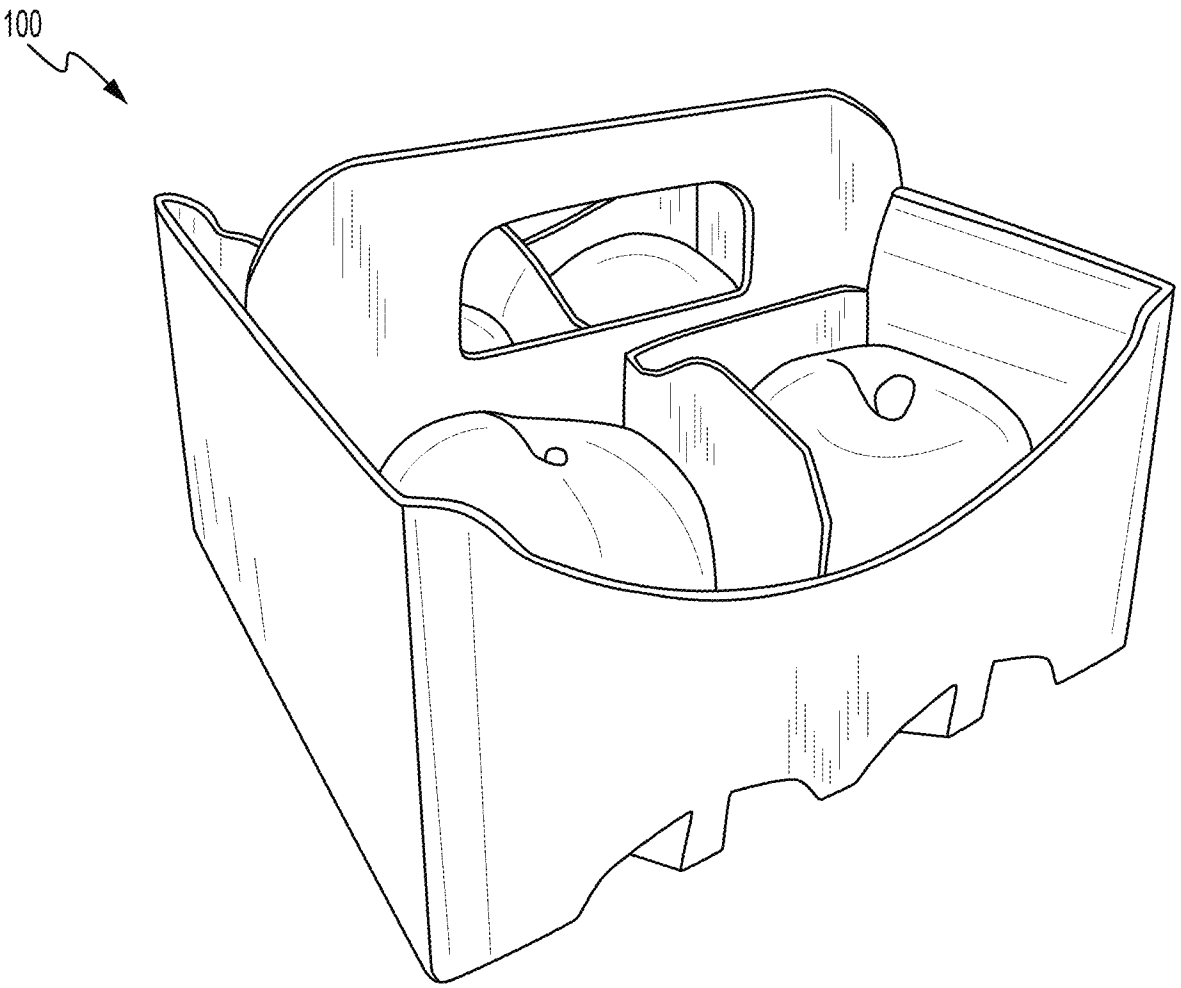
FIG. 1C is a perspective view of the embodiment of FIG. 1A, shown having the divider handle in an extended position and having the partitions thereof dividing the interior space into four compartments, and having an embodiment of product disposed in each compartment thereof.

In certain embodiments, e.g., as shown in FIGS. 1A-1C, the divider handle 111 can be configured to moveably attach to the body 101 such that the divider handle 111 is configured to move between a first position (e.g., as shown in FIGS. 1A and 1B) and a second position (e.g., as shown in FIG. 1C). The divider handle 111 can be configured to be slidably retained by the body 101 such that the divider handle 111 can be configured to slide between the first position and the second position.

The body 101 can define a plurality of slide apertures 113 (e.g., under slide aperture panels 115*a*, 115*b*, 115*c*, 115*d*, described further below) configured to receive a slide panel 117*a*, 117*b*, 117*c*, 117*d* (not visible in FIGS. 1A-1C, e.g., shown in FIG. 2B) of the divider handle 111 to allow the divider handle 111 to slide between the first position and the second position. The side wall 107 can be formed from a plurality of side panels 117*a, b, c, d*. The container 100 can include a plurality of slide aperture panels 115*a, b, c, d* foldably connected to opposing side panels (e.g., 107*b*, 107*d*) of the plurality of side panels 117*a, b, c, d* (e.g., at an opposite end of side panels 107*b*, 107*d* from the bottom 109). For example, as shown, the slide aperture panels 115*a, b* can be foldably connected to side panel 117*b*, and the slide aperture panels 115*c, d* can be foldably connected to side panel 117*d*. The slide aperture panels 115*a, b, c, d* can fold over a respective side panel 117*b*, 117*d* to a folded position to form the slide apertures 113 (e.g., as shown).

The slide aperture panels 115*a, b, c, d* can be configured to connect to the body 101 (e.g., via one or more tabs 119 further described below) to retain the slide aperture panels 115*a, b, c, d* in the folded position. In certain embodiments, the first position can be a recessed position within the interior space 105 (e.g., such that a top of the divider handle 111 is flush with or under a top of side panels 107*b*, 107*d*). The second position can be an extended position extending from the interior space 105 and interacting with the body 101, e.g., such that the divider handle 111 allows lifting of the body 101 in at least the extended position (e.g., as shown in FIG. 1C).

Figure 2A:
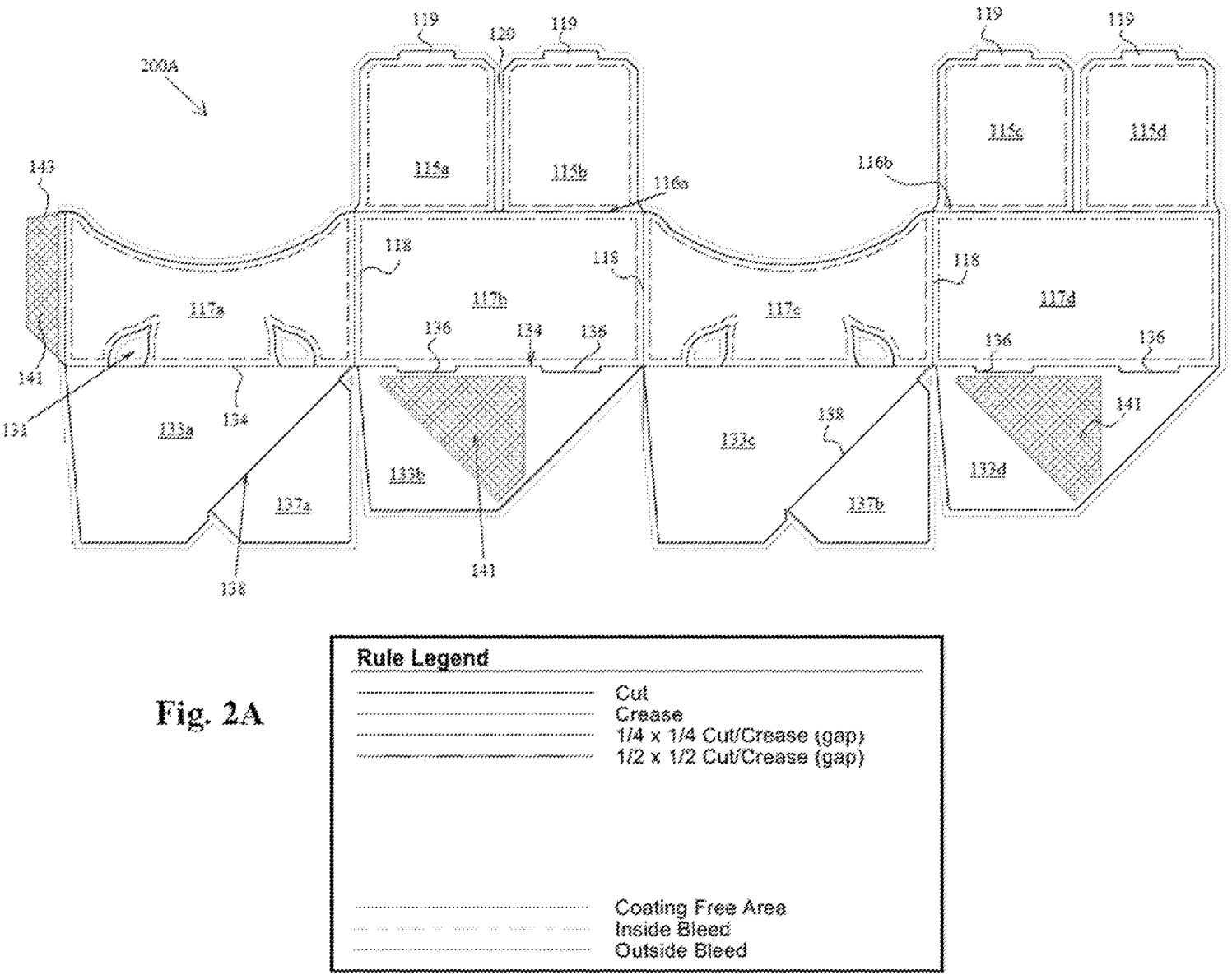
FIG. 2A is a plan view of an embodiment of a first blank in accordance with this disclosure configured to form the body of the embodiment of FIG. 1A.
Figure 2B:
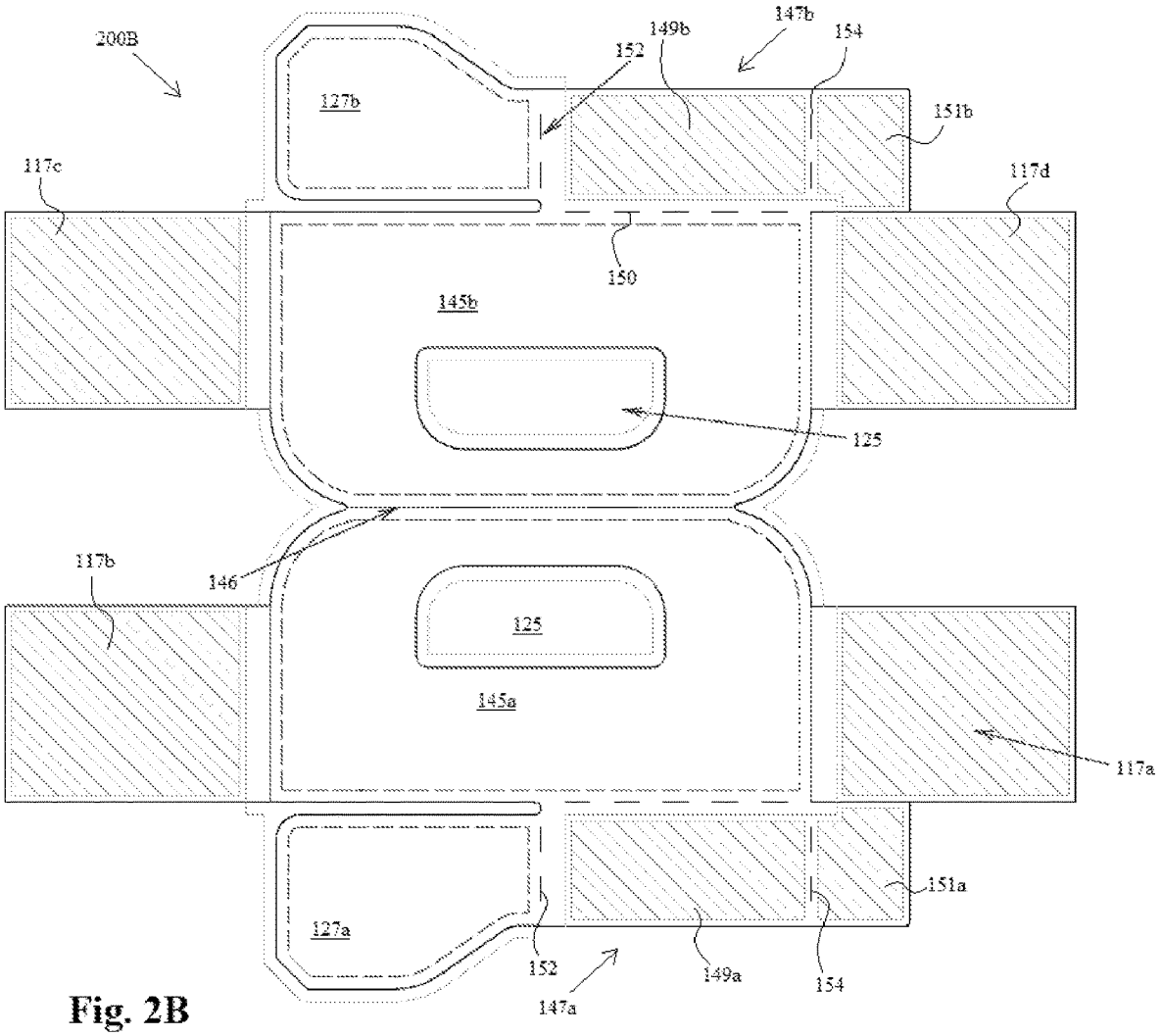
FIG. 2B is a plan view of an embodiment of a second blank in accordance with this disclosure configured to form the divider handle of the embodiment of FIG. 1A.
Figure 3A:
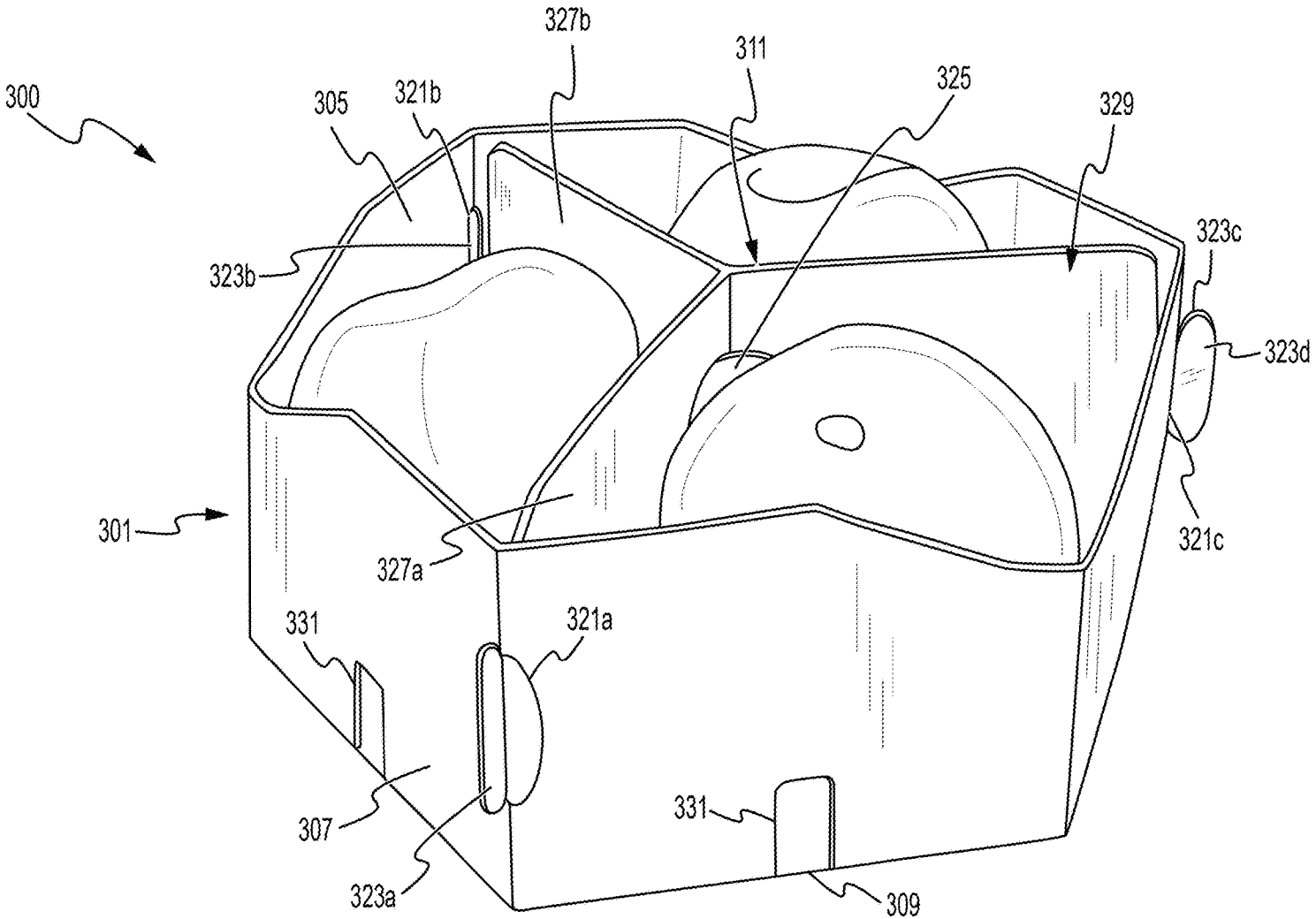
FIG. 3A is a perspective view of an embodiment of a container in accordance with this disclosure, shown in a formed position and having a divider handle thereof connected to a body thereof and forming three compartments, and showing an embodiment of a product disposed in each compartment thereof.
Figure 3B:
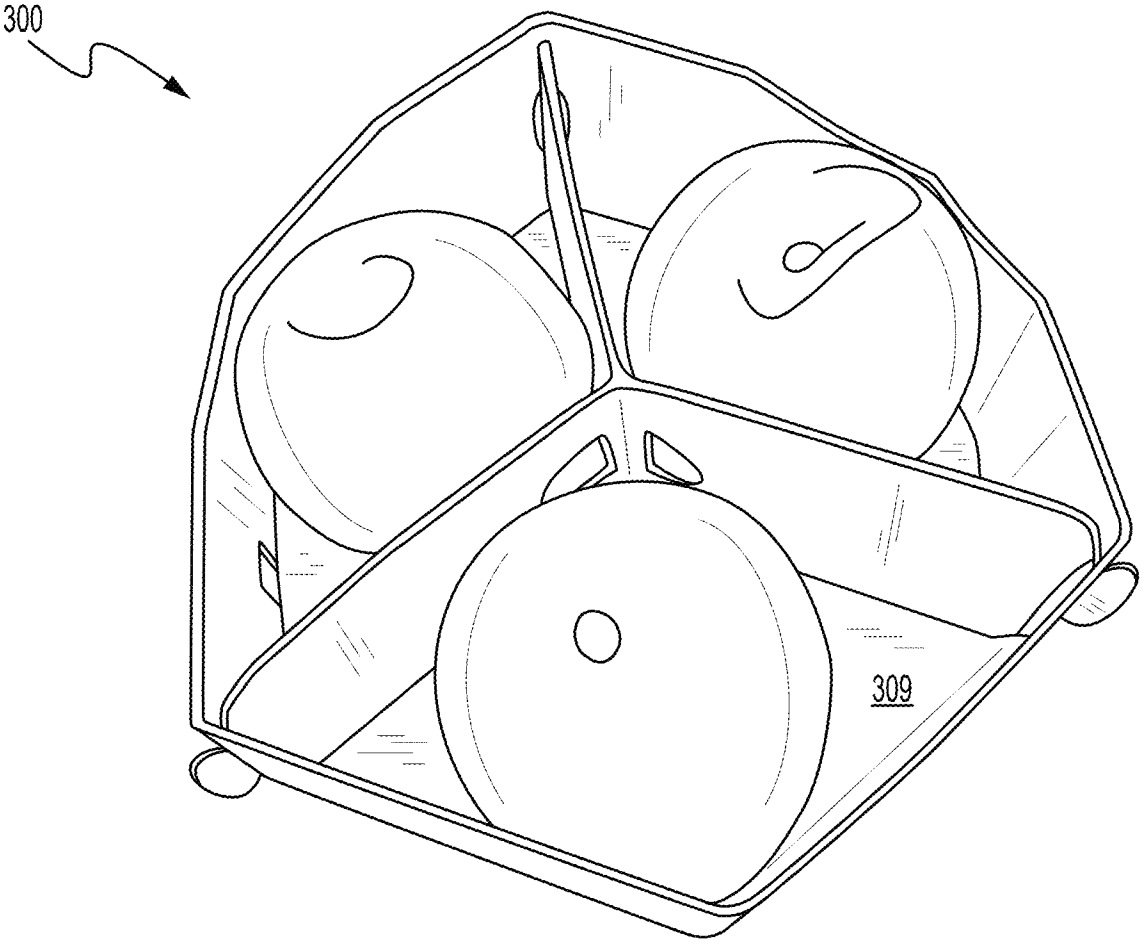
FIG. 3B is a perspective view of the embodiment of FIG. 3A.
Figure 3C:
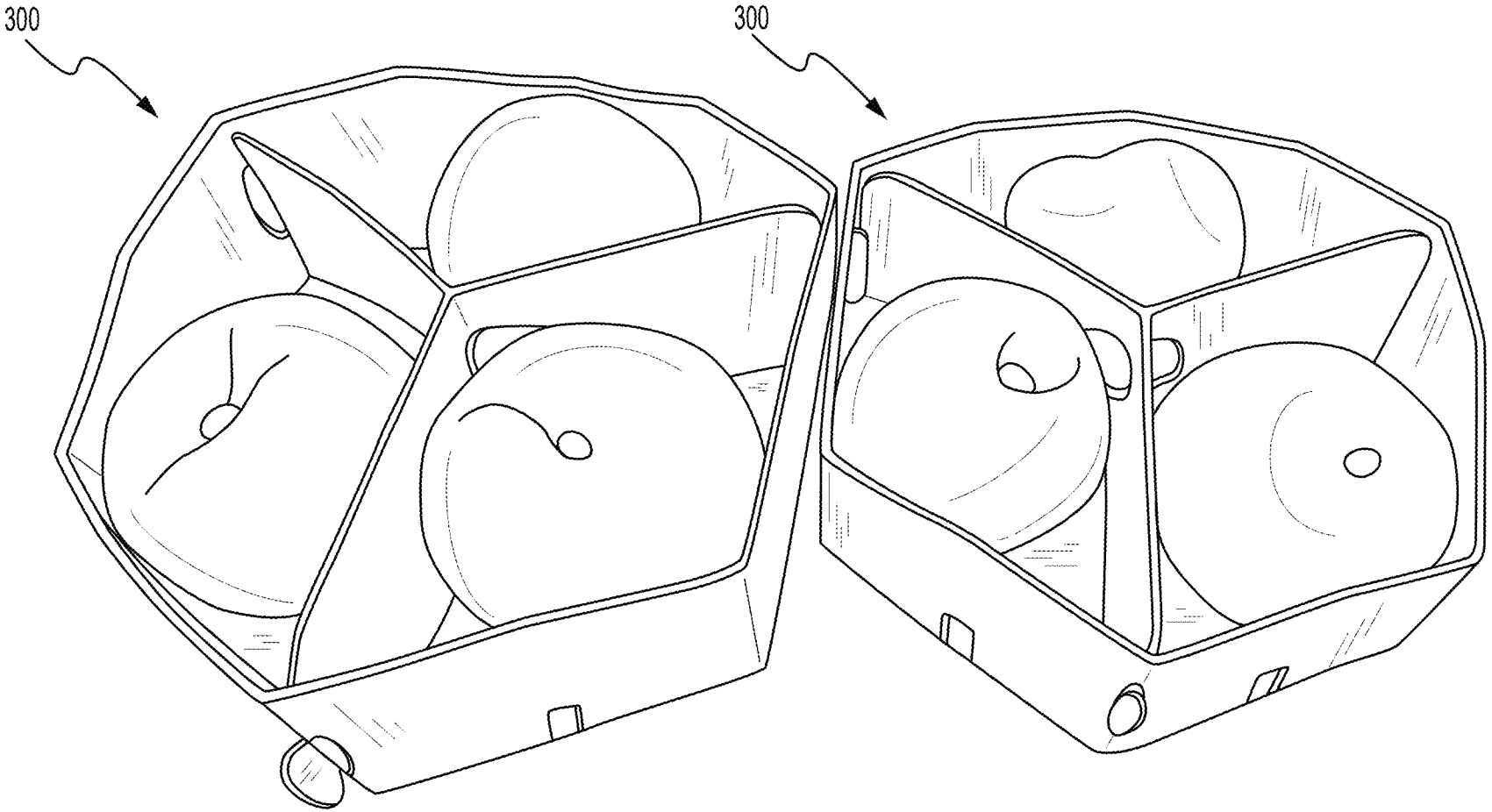
FIG. 3C is a perspective view of a plurality the embodiment of FIG. 3A partially stacked together.

Referring to FIGS. 3A-3C, in certain embodiments, the divider handle 311 can be configured to be fixed relative to the body 301. The body 301 can include a plurality of attachment apertures 321*a*, 321*b*, 321*c*, and the divider handle 311 can include a plurality of attachments (e.g., attachment tabs 323*a*, 323*b*, 323*c*, 323*d*) configured to insert into the attachment apertures 321*a*, 321*b*, 321*c* to fix the divider handle 311 to the body 301 and to allow the body 301 to be lifted by the divider handle 311. The attachments 323*a, b, c, d* and apertures 321*a, b, c* can include any suitable shape (e.g., a hook and elliptical opening as shown). Referring to FIGS. 1A-4B, in certain embodiments, the divider handle 111, 311 can include a handle opening 125, 325 (e.g., one or more) defined therein. In certain embodiments, the divider handle 111, 311 can include one or more moveable partition panels 127*a*, 127*b*, 327*a*, 327*b* configured to move relative to a main handle portion 129, 329 of the divider handle 111, 311 to further divide the interior space 105, 305. The moveable partition panels 127*a, b*, 327*a, b* can include two movable partition panels, for example (e.g., as shown).

As shown in FIGS. 1A-1C, in certain embodiments, the moveable partition panels 127*a, b* can be foldably connected to the main handle portion 129 and configured to selectively divide the interior space 105 (e.g., to provide a configurable interior space having two, three, or four compartments as desired, for example). The divider handle 311 can be configured to divide the interior space into two, three, or four compartments, for example.

As shown in FIGS. 3A-3C, in certain embodiments, the moveable partition panels 327*a, b* can be configured to connect to the body 301 and can each include one of the plurality of attachments 323*a*, 323*b* configured to insert into the attachment apertures 321*a*, 321*b*, for example. In certain embodiments, the moveable partition panels 327*a, b* can include a portion of the handle opening 325.

Referring to FIGS. 1A-4B, in certain embodiments, the bottom 109, 309 can be an autobottom configured to move between a flattened state and a formed state. Any autobottom is contemplated herein, and any suitable bottom panels to form an autobottom are contemplated herein. In certain embodiments, the container 100, 300 can include one or more vent holes 131, 331 defined in the side wall 107, 307 and/or the bottom 109, 309.

In accordance with at least one aspect of this disclosure, referring to FIGS. 2A and 2B, and FIGS. 4A and 4B, a plurality of blanks 200A, 200B and 400A, 400B, or a blank (not shown) configured to be separated into the plurality of blanks 200A, 200B and 400A, 400B, can be configured to form a container as disclosed herein, e.g., container 100, 300 as described above. For example, in accordance with at least one aspect of this disclosure, a plurality of blanks 200A, B, 400A, B for forming a container 100, 300, respectively, can include a first blank 200A, 400A configured to form a body as disclosed herein, e.g., body 101, 301 as described above. The plurality of blanks 200A, B, 400A, B can include a second blank 200B, 400B configured to form a divider handle as disclosed herein, e.g., divider handle 111, 311 as described above.

Referring to FIG. 2A, in certain embodiments, the first blank 200A can include a first, second, third, and fourth side panel 117*a, b, c, d* foldably connected together (e.g., along vertical fold lines 118, for example). The first blank 200A can include a first, second, third, and fourth bottom panel 133*a, b, c, d* foldably connected to a respective side panel 117*a, b, c, d* (e.g., as shown) along a common fold line 134. In certain embodiments, the bottom panels 133*a, b, c, d* can be configured to form any suitable autobottom as appreciated by those having ordinary skill in the art.

For example, as shown, the second bottom panel 133*b* and the fourth bottom panel 133*d* can be connected to (e.g., adhered via adhesive 141) to a first extension panel 137*a* and a second extension panel 137*b*, respectively. The first extension panel 137*a* can be foldably connected to the first bottom panel 133*a*, and the second extension panel 137*b* can be foldably connected to the third bottom panel 133*c* at a fold line 139. The first side panel 117*a* can be foldably connected to a connector tab 143 (e.g., with adhesive 141 disposed thereon) that is configured to connect to a last side panel, e.g., side panel 117*d* (e.g., to form side wall 107). Any other suitable panels or positions thereof are contemplated herein.

The first blank can 200A include a first and second slide aperture panel 115*a, b* foldably connected (e.g., at a fold line 116*a*) to the second side panel 117*b* opposite the second bottom panel 133*b*, for example. The first blank 200A can include a third and fourth slide aperture panel 115*c, d* foldably connected (e.g., at fold line 116*b*) to the fourth side panel 117*d* opposite the fourth bottom panel 133*d*.

The first, second, third, and fourth slide aperture panels 115*a, b, c, d* can include a tab 119 extending therefrom. The second and fourth bottom panels 133*b*, 133*d* can include a respective tab cut 136 (e.g., starting at fold line 134 as shown) for each tab 119. Each tab 119 can be configured to be inserted into each respective tab cut 136 to retain each slide aperture panel 115*a, b, c, d* in a folded over position (e.g., as shown in FIGS. 1A-1C) where the aperture panels 115*a, b, c, d* form a respective slide aperture 113 (e.g., the space between panels 115*a, b, c, d* and the side panels 117*b*, 117*d*). As shown, there can be a gap 120 between the slide aperture panels 115*a*, 115*b* and 115*c*, 115*d* to allow the main handle portion 129 to slide upwardly.

The first blank 200A can include one or more vent holes 131 disposed therein. The vent holed 131 can include any suitable shape (e.g., an ornamental shape such as a leaf) and can include any suitable placement (e.g., bottom along the fold line 134 and only in the side panel, partly in the side panel and the bottom panel, etc.).

In certain embodiments, referring to FIG. 2B, the second blank 200B can include a first and second main handle panel 145*a, b* foldably connected together (e.g., at a fold line 146). Each handle panel 145*a, b* can include a handle aperture 125 defined therein (e.g., configured to allow one or more fingers to insert therethrough for grabbing the divider handle 111). The second blank 200B can include a first and second slide panel 117*a*, 117*b* foldably connected to opposite sides of the first main handle panel 145*a*, and dimensioned to fit within and slide within a respective slide aperture 113. The second blank 200B can include a third and fourth slide panel 117*c*, 117*d* foldably connected to opposite sides of the second main handle panel 145*b*, and dimensioned to fit within and slide within a respective slide aperture 113.

When the main handle panels 145*a*, 145*b* are folded over to form the main handle portion 129, adjacent slide panels 117*a*, 117*d*, and 117*c*, 117*b* can be folded away from each other. The slide aperture panels 115*a, b, c, d* can then be folded over each respective slide panel 117*a, b, c, d* and secured to the bottom panels 133*b*, 133*d* using the tabs 119 and respective tab cuts 136. The slide panels 115*a, b, c, d* can be less vertically tall than the slide apertures 113, and thus can allow the divider handle 111 to slide vertically until the slide panels 117*a, b, c, d* contact an upper surface of the slide apertures 113 (e.g., the fold line 116*a*, 116*b*). Any other method or structure for assembly is contemplated herein.

The second blank 200B can include a first moveable partition panel assembly 147*a* foldably connected to the first main handle panel 145*a*. The second blank 200B can include a second moveable partition panel assembly 147*b* foldably connected to the second main handle panel 145*b*.

The first and second moveable partition panel assemblies 147*a, b* can each include a connecting panel 149 foldably connected to a respective main handle panel 145*a, b* (e.g., at a fold line 150), a partition panel foldably 127*a*, 127*b* connected to a respective connecting panel 149*a*, 149*b* (e.g., at a fold line 152), and a slider panel 151*a*, 151*b* foldably connected to the connecting panel 149*a*, 149*b* (e.g., at fold line 154) and extending laterally beyond the respective main handle panel 145*a*, 145*b*, e.g., as shown. The slider panel 151*a, b* can be configured to fit within a slide aperture 113 with a respective slide panel 117*a*, 117*d*. For example, before enclosing the first and fourth slide panels 117*a*, 117*d*, the connecting panels 149*a*, 149*b* can be folded up against the respective main handle panels 145*a*, 145*b* and the slider panels 151*a, b* can be folded with the slide panels 117*a*, 117*d*, respectively. The partition panels 127*a, b* can be selective folded relative to the connecting panel 149*a, b* to further divide the interior space in use.

Figure 4A:
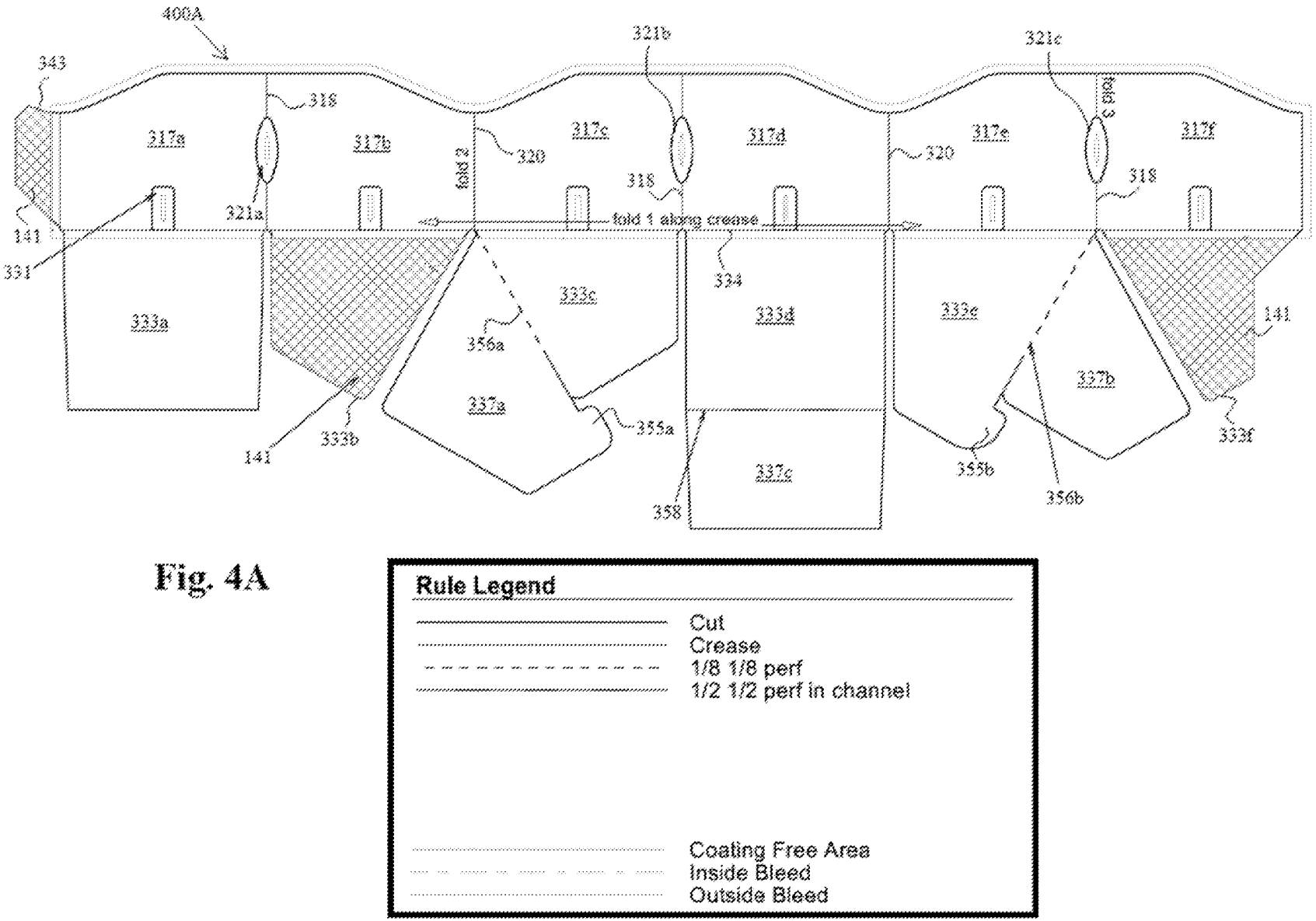
FIG. 4A is a plan view of an embodiment of a first blank in accordance with this disclosure configured to form the body of the embodiment of FIG. 3A.

Referring to FIG. 4A, in certain embodiments, the first blank 400A can include a first, second, third, fourth, fifth, and sixth side panel 317, b, c, d, e, f foldably connected together (e.g., via vertical fold lines 318, 320), a first, second, third, fourth, fifth, and sixth bottom panel 333*a, b, c, d, e, f* foldably connected to a respective side panel along a common fold line 334, and a first, second, and third attachment aperture 321*a, b, c* disposed in the side panels 317*a, b, c, d, e, f* (e.g., centered on fold lines 318). The first attachment aperture 321*a* can be defined in the first and second side panels 317*a*, 317*b*. The second attachment aperture 321*b* can be defined in the third and fourth side panels 317*c*, 317*d*. The third attachment aperture 321*c* can be defined in the fifth and sixth panels 317*e*, 317*f*. The attachment apertures 321*a, b, c* can each be disposed in a fold line 318 between a respective panel pair, e.g., as shown.

The first blank 400A can the bottom panels 333*a, b, c, d, e, f* can be configured to form an autobottom. Any suitable autobottom is contemplated herein. In certain embodiments, the third bottom panel 333*c* and the fifth bottom panel 333*e* can include a locking tab 355*a*, 335*b* connected thereto and/or extending therefrom configured to lock together in a formed position (e.g., as shown in FIGS. 3A-3C).

For example, as shown, the second bottom panel 133*b* and the sixth bottom panel 133*d* can be connected to (e.g., adhered via adhesive 141) to a first extension panel 337*a* and a second extension panel 137*b*, respectively. The first extension panel 137*a* can be foldably connected to the second bottom panel 333*a*, and the second extension panel 337*b* can be foldably connected to the fifth bottom panel 333*e* at a fold line 356*a*, 356*b*, respectively. As shown, the first locking tab 355*a* can extend from the first extension panel 337*a*, whereas the second locking tab 355*b* can extend from the fifth bottom panel directly and not from the second extension panel 337*b*. Any other suitable arrangement is contemplated herein. The locking tabs 355*a*, 355*b* can be configured to lock together when the container is in a formed position, which can strengthen the bottom 309 and resist moving back to a flatten position.

A third extension panel 337*c* can extend from and/or be connected to the fourth bottom panel 333*d*, e.g., at a fold line 358. The third extension panel 337*a* can be connected to the first bottom panel 333*a* (e.g., via adhesive, not shown) underneath the other bottom panels, for example. In certain embodiments, in the formed position, the lines 356*a*, 356*b*, and 358 may be aligned. Any suitable arrangement and/or connection is contemplated herein to achieve a suitable autobottom.

The first side panel 317*a* can be foldably connected to a connector tab 343 (e.g., with adhesive 141 disposed thereon) that is configured to connect to a last side panel, e.g., side panel 317*f* (e.g., to form side wall 307). Any other suitable panels or positions thereof are contemplated herein.

Figure 4B:
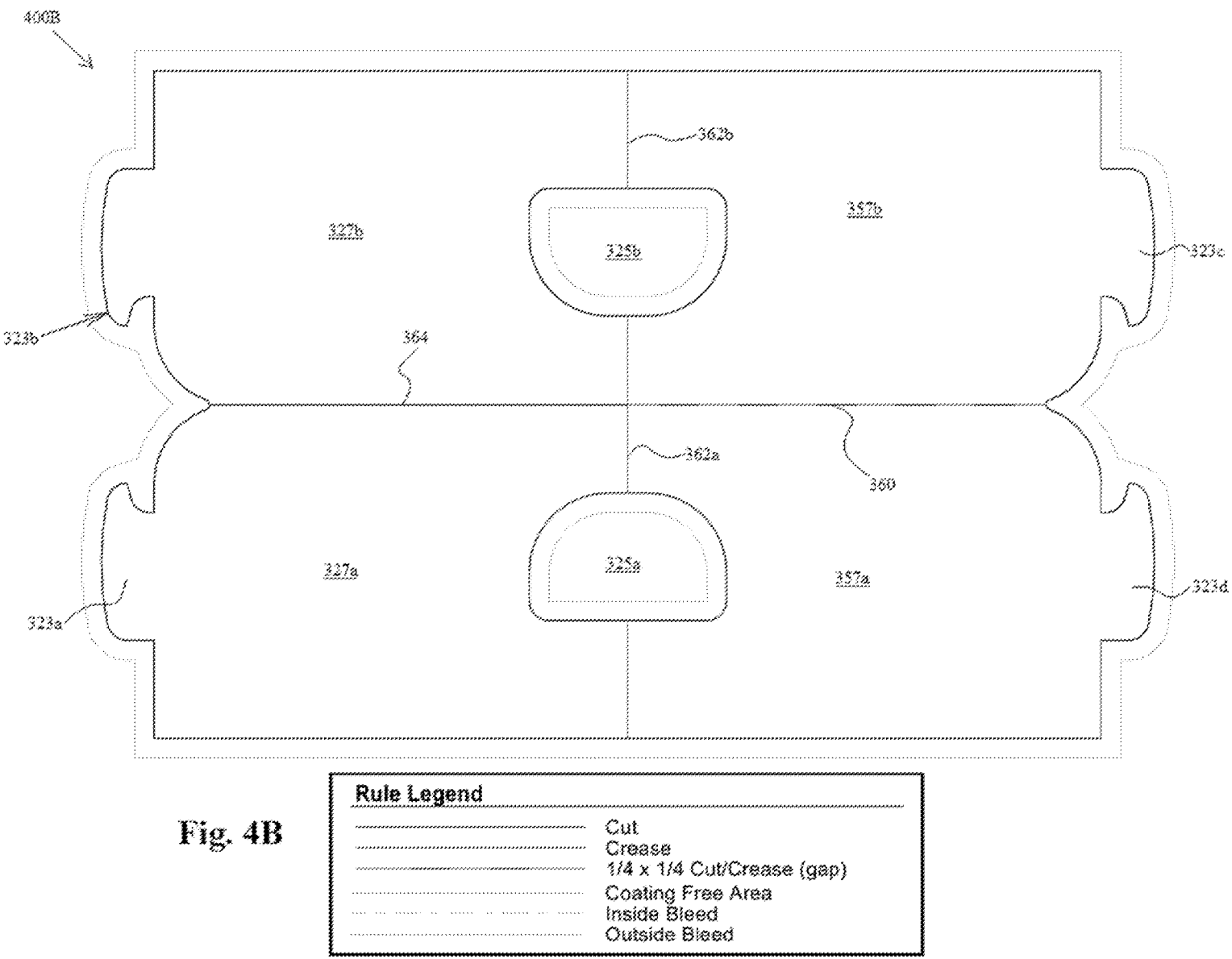
FIG. 4B is a plan view of an embodiment of a second blank in accordance with this disclosure configured to form the divider handle of the embodiment of FIG. 3A.

Referring to FIG. 4B, the second blank 400B can include a first and second main handle panel 357*a*, 357*b* foldably connected to each other (e.g., at fold line 360). A first and second partition panel 327*a*, 327*b* can be foldably connected to the first and second main handle panel 357*a*, 357*b*, respectively (e.g., via fold line 362*a*, 362*b*). The partition panels 327*a*, 327*b* can be separated from each other via a cut line 364, e.g., as shown, or any other suitable space. In certain embodiments, the first and second partition panels 327*a*, 327*b* are not directly connected, e.g., as shown. The second blank 400B can include a first handle aperture 325*a* defined between the first main handle panel 357*a* and the first partition panel 327*a* (e.g., centered in fold line 362*a*), and a second handle aperture 325*b* defined between the second main handle panel 357*b* and the second partition panel 327*b* (e.g., centered in fold line 362*b*). The first and second handle aperture 325*a, b* can form the handle opening 325.

In certain embodiments, the first and second partition panels 327*a*, 327*b* can be shaped as a mirror image of each respective main handle panels 357*a*, 357*b*, e.g., as shown. In certain embodiments, the first and second partition panels 327*a*, 327*b* can include a first and second attachment tab 323*a*, 323*b* extending therefrom, respectively. The first and second main handle panels 357*a*, 357*b* can include a third and fourth attachment tab 323*c*, 323*d* extending therefrom, e.g., as shown. Referring additionally to FIG. 4A, the first attachment tab 323*a* can be configured to insert into the first attachment aperture 321*c* and the second attachment tab 323*b* can be configured to insert into the second attachment aperture 321*b*, for example. The third and fourth attachment tabs 323*c*, 323*d* can be configured to insert together into the third attachment aperture 321*c* (e.g., when main handle panels 357*a, b* are folded over and contacting each other), for example. Any other suitable arrangement is contemplated herein.

Embodiments can include separate moveable or stationary divider handles. Certain embodiments allow for a two, three, or four way divider, for example, or any other suitable number of divisions.

In certain embodiments, the divider handle can slide up and down. In the recessed position, and/or where the divider handle is fixed in place, the divider handle can be flush with a side wall or lower, e.g., to allow stacking. Embodiments can include ventilation holes, e.g., at least partly in the sides and/or bottom to allow ventilation. Embodiments of ventilation holes can include non-straight edges (e.g., to increase airflow). Embodiments can include two or more holes per compartment and/or can be defined in both side panels and bottom panels, for example.

Embodiments can provide an efficient and customizable buying experience with a telescoping, removable handle, for example. Embodiments of a container can be a basket or other suitable carrier and can have two pieces. Embodiments can include an auto bottom style base (e.g., square autobottom, hexagonal autobottom, etc.) and a separate insert that acts as a handle and divider (e.g., which can be collapsible, telescoping or fixed). Embodiments can also incorporate scalloped cuts on side panels and/or bottom panels, and/or die cut leaves or other ornamental shapes which can deliver a basket aesthetic.

Embodiments can be used in any suitable applications, e.g., bakery/deli in retail chains, take-out food (sporting events, doughnuts, fast food), beverages (beer/cans), pies, mini pies, and/or other desserts. Embodiments can provide a sustainable alternative for current plastic baskets because embodiments need not be plastic (but could be). For example, embodiments can be made of Kraft board which can provide an earthy, "new-age" aesthetic appeal.

Any suitable adhesive can be applied to any suitable panel disclosed herein for any suitable purpose. Any suitable foldable line types are contemplated herein (e.g., perforated, creased, cut/creased, etc.). While the figures may include a legend indicating the line types of the embodiments of the figures, any other suitable line types for the lines shown in the drawings are contemplated herein. Any other suitable panel arrangement (e.g., more or less panels in any suitable location) is contemplated herein.

While embodiments have been described and shown above, any suitable panels and/or other design for a blank to form a package as disclosed above is contemplated herein. Any suitable material for use (e.g., paper, cardboard, e.g., corrugated paperboard, plastic board, etc.) and/or one or more combinations thereof are contemplated herein. One having ordinary skill in the art understands how to make and use a container as disclosed above from the embodiments of a blank disclosed herein without undue experimentation.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A container configured to carry a plurality of articles, comprising:

a body configured to form an interior space, the body including at least a side wall and a bottom; and a divider handle configured to attach to the body, the divider handle forming a handle and at least one divider configured to divide the interior space into at least two compartments, wherein the divider handle comprises one or more moveable partition panels foldably connected to a main portion of the divider handle, and configured to move relative to the main portion of the divider handle via its foldable connection thereto and to selectively further divide the interior space into one or more additional compartments.

2. The container of claim 1, wherein the divider handle is configured to be fixed relative to the body, wherein the body comprises a plurality of attachment apertures, and wherein the divider handle comprises a plurality of attachments configured to insert into the attachment apertures to fix the divider handle to the body and to allow the body to be lifted by the divider handle.

3. The container of claim 1, wherein the divider handle comprises a handle opening defined therein.

4. The container of claim 1, wherein the bottom is an autobottom configured to move between a flattened state and a formed state.

5. A plurality of blanks or a blank configured to be separated into the plurality of blanks, the plurality of blanks configured to form a container of claim 1.

6. A container configured to carry a plurality of articles, comprising:

a body configured to form an interior space, the body including at least a side wall and a bottom; and a divider handle configured to attach to the body, the divider handle forming a handle and at least one divider configured to divide the interior space into at least two compartments, wherein the divider handle comprises one or more moveable partition panels foldably connected to a main portion of the divider handle, wherein the divider handle is configured to moveably attach to the body such that the handle is configured to move between a first position and a second position, and wherein the divider handle is configured to be slidably retained by the body such that the divider handle is configured to slide between the first position and the second position.

7. The container of claim 6, wherein the body defines a plurality of slide apertures configured to receive a slide panel of the divider handle to allow the divider handle to slide between the first position and the second position.

8. The container of claim 7, wherein the side wall comprises a plurality of sides formed from a plurality of side panels, wherein the container comprises a plurality of slide aperture panels foldably connected to opposing side panels of the plurality of side panels, wherein the slide aperture panels fold over a respective side panel to a folded position to form the slide apertures, wherein the slide aperture panels are configured to connect to the body at a distal portion of the slide aperture panels to retain the slide aperture panels in the folded position.

9. The container of claim 6, wherein the first position is a recessed position within the interior space, and the second position is an extended position extending from the interior space and interacting with the body such that the divider handle allows lifting of the body in at least the extended position.

10. A plurality of blanks for forming a container, comprising:

a first blank configured to form a body, the body configured to form an interior space and comprising at least a side wall and a bottom; and a second blank configured to form a divider handle, the divider handle configured to attach to the body, the divider handle forming a handle and at least one divider configured to divide the interior space into at least two compartments, wherein the second blank comprises one or more moveable partition panels foldably connected to a main portion of the divider handle, and configured to move relative to the main portion of the divider handle via its foldable connection thereto and to selectively further divide the interior space into one or more additional compartments.

11. The plurality of blanks of claim 10, wherein the first blank comprises:

a first, second, third, and fourth side panel foldably connected together;

a first, second, third, and fourth bottom panel foldably connected to a respective side panel along a common fold line;

a first and second slide aperture panel foldably connected to the second side panel opposite the second bottom panel;

a third and fourth slide aperture panel foldably connected to the fourth side panel opposite the fourth bottom panel.

12. The plurality of blanks of claim 11, wherein the first, second, third, and fourth slide aperture panels comprise a tab extending therefrom, wherein the second and fourth bottom panels comprise a respective tab cut for each tab, wherein each tab is configured to be inserted into each respective tab cut to retain each slide aperture panel in a folded over position where the aperture panels form a respective slide aperture.

13. The plurality of blanks of claim 11, wherein the second blank comprises:

a first and second main handle panel foldably connected together, each handle panel comprises a handle aperture defined therein;

a first and second slide panel foldably connected to opposite sides of the first main handle panel, and dimensioned to fit within and slide within a respective slide aperture; and a third and fourth slide panel foldably connected to opposite sides of the second main handle panel, and dimensioned to fit within and slide within a respective slide aperture.

14. The plurality of blanks of claim 13, wherein the one or more moveable partition panels further comprise:

a first moveable partition panel assembly foldably connected to the first main handle panel; and a second moveable partition panel assembly foldably connected to the second main handle panel.

15. The plurality of blanks of claim 14, wherein the first and second moveable partition panel assemblies each comprises:

a connecting panel foldably connected to a respective main handle panel;

a partition panel foldably connected to the connecting panel; and a slider panel foldably connected to the connecting panel and extending laterally beyond the respective main handle panel, the slider panel configured to fit within a slide aperture with a respective slide panel.

16. The plurality of blanks of claim 10, wherein the first blank comprises:

a first, second, third, fourth, fifth, and sixth side panel foldably connected together;

a first, second, third, fourth, fifth, and sixth bottom panel foldably connected to a respective side panel along a common fold line; and a first, second, and third attachment aperture disposed in the side panels, wherein the first attachment aperture is defined in the first and second side panels, wherein the second attachment aperture is defined in the third and fourth side panels, and wherein the third attachment aperture is defined in the fifth and sixth panels, wherein the attachment apertures are each disposed interrupting a fold line between a respective panel pair.

17. The plurality of blanks of claim 16, wherein the first, second, third, fourth, fifth, and sixth bottom panel of the first blank are configured to form an autobottom, wherein the third bottom panel and the fifth bottom panel each comprise a locking tab connected thereto and/or extending therefrom configured to lock together in a formed position.

18. The plurality of blanks of claim 17, wherein the second blank comprises:

a first and second main handle panel foldably connected to each other;

a first and second partition panel foldably connected to the first and second main handle panel, respectively, the first and second partition panel not directly connected;

a first handle aperture defined between the first main handle panel and the first partition panel; and a second handle aperture defined between the second main handle panel and the second partition panel.

19. The plurality of blanks of claim 18, wherein the first and second partition panels are shaped as a mirror image of each respective main handle panel, wherein the first and second partition panels comprise a first and second attachment tab extending therefrom, respectively, wherein the first and second main handle panels comprise a third and fourth attachment tab extending therefrom, respectively, wherein the first attachment tab is configured to insert into the first attachment aperture, wherein the second attachment tab is configured to insert into the second attachment aperture, and wherein the third and fourth attachment tabs are configured to insert together into the third attachment aperture.

* * * * *